US007104473B2

(12) United States Patent
Bosio

(10) Patent No.: US 7,104,473 B2
(45) Date of Patent: Sep. 12, 2006

(54) PULL-OUT KITCHEN SPRAYER

(75) Inventor: Orlando Bosio, Casaloldo (IT)

(73) Assignee: AMFAG S.p.A., Castel Goffredo (IT)

( * ) Notice: Subject to any disclaimer, the term of this patent is extended or adjusted under 35 U.S.C. 154(b) by 645 days.

(21) Appl. No.: 10/401,836

(22) Filed: Mar. 31, 2003

(65) Prior Publication Data

US 2003/0189108 A1 Oct. 9, 2003

(30) Foreign Application Priority Data

Apr. 4, 2002 (IT) ..... MN2002A0013

(51) Int. Cl.
*A62C 31/00* (2006.01)

(52) U.S. Cl. ..... 239/449; 239/445
(58) Field of Classification Search ..... 239/445, 239/449, 588; 4/677, 678
See application file for complete search history.

(56) References Cited

U.S. PATENT DOCUMENTS 5,699,832 A 12/1997 Burchard et al.
6,013,268 A 1/2000 Reed
6,183,636 B1 * 2/2001 Bowers et al. ..... 210/232
6,381,774 B1 * 5/2002 Wales ..... 4/678
6,387,888 B1 5/2002 Mincheff et al.
6,451,593 B1 9/2002 Wittig et al.
6,495,130 B1 12/2002 Henderson et al.
6,612,507 B1 * 9/2003 Meyer et al. ..... 239/394
6,757,921 B1 * 7/2004 Esche ..... 4/677

FOREIGN PATENT DOCUMENTS

DE 23 59 189 6/1975
EP 0 756 038 1/1997
EP 1 078 692 2/2001

OTHER PUBLICATIONS

PCT International Search Report mailed Apr. 5, 2004 in International application No. PCT/US03/10096.

* cited by examiner

*Primary Examiner*—Michael Mar
(74) *Attorney, Agent, or Firm*—Guido Modiano; Albert Josif; Daniel O'Byrne

(57) ABSTRACT

A pull-out kitchen sprayer, comprising a central body that is accommodated within an outer enclosure whose shape is such as to require assembly with a particular orientation, the central body comprising a switching device with a slider and a rod provided with a flow control element and with actuation buttons at its two ends, the outer enclosure having facing openings that allow to access the buttons, one of the openings being formed so as to face the user.

7 Claims, 3 Drawing Sheets

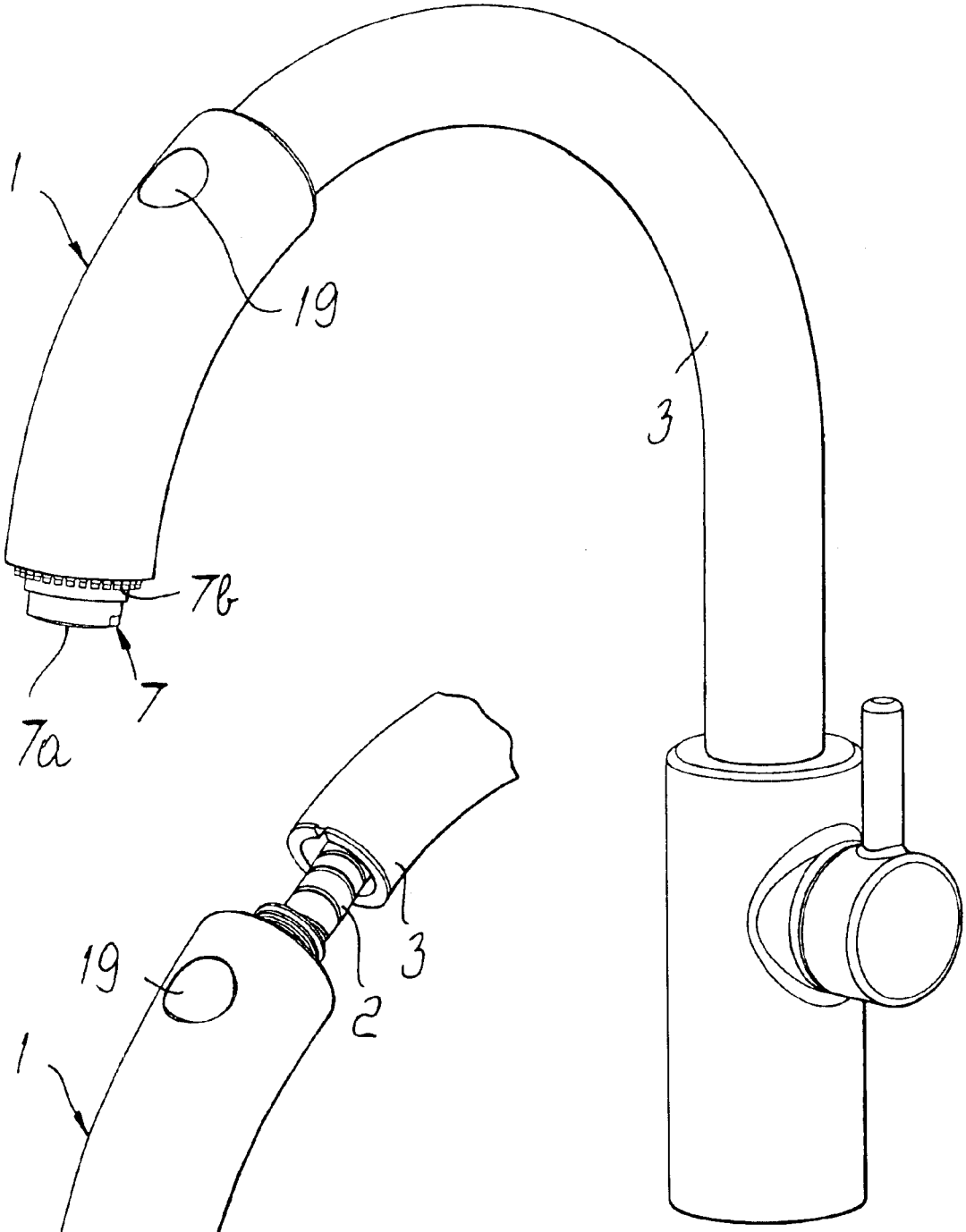
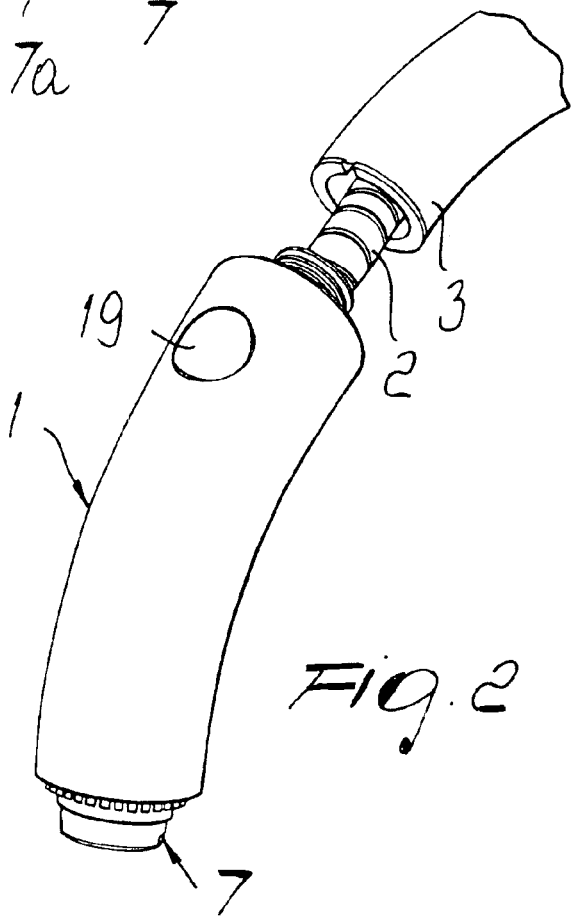
Fig. 2
Fig. 1

PULL-OUT KITCHEN SPRAYER

BACKGROUND OF THE INVENTION

The invention relates to a pull-out kitchen sprayer or shower head.

The great diffusion achieved by so-called kitchen sprayers or shower heads is known; such kitchen sprayers are connected to a flexible hose, so that they can be pulled out of faucets in order to reach distant positions within sinks, and convey water with the possibility to provide the outflow of the water as a central jet or as a peripheral jet by operating a switching device provided for this purpose.

SUMMARY OF THE INVENTION

The aim of the present invention is to provide a pull-out kitchen sprayer having a shape that allows it to be gripped easily by a user and having a switching device that is very simple and very handy to operate.

The proposed aim is achieved by a pull-out kitchen sprayer or shower head, according to the invention, which comprises a central body that is accommodated within an outer enclosure whose shape is such as to require assembly with a particular orientation with respect to the position of the user, said central body being designed to convey water between an inlet associated with a flexible water feed hose and an outlet disk that comprises a central passage and peripheral passages, and comprising a switching device that is adapted to provide the access of the water selectively to a duct that is connected to said central passage and to a duct that is connected to said peripheral passages, said switching device comprising a distribution unit that is adapted to be inserted in a suitable seat formed in said central body in the presence of locking means and is provided with a water inlet and with first and second outlets, which are open respectively onto the duct connected to the central passage and onto the duct connected to the peripheral passages, furthermore comprising a slider that comprises a rod for supporting a flow control element, said rod being guided in said distribution unit so that it can move between the two positions in which said first and second outlets are selectively closed, said rod being provided, at its two ends, with actuation buttons, characterized in that said outer enclosure is provided with facing openings that allow a user to access said buttons, one of said openings being formed so as to face the user.

BRIEF DESCRIPTION OF THE DRAWINGS

Further characteristics and advantages of the invention will become better apparent from the description of a preferred but not exclusive embodiment thereof, illustrated only by way of non-limitative example in the accompanying drawings, wherein:

FIG. 1 is a view of the sprayer according to the invention in the position in which it is contact with the tubular body comprised within the faucet;

FIG. 2 is a view of said sprayer in the extraction position;

DESCRIPTION OF THE PREFERRED EMBODIMENTS

Figure 3:
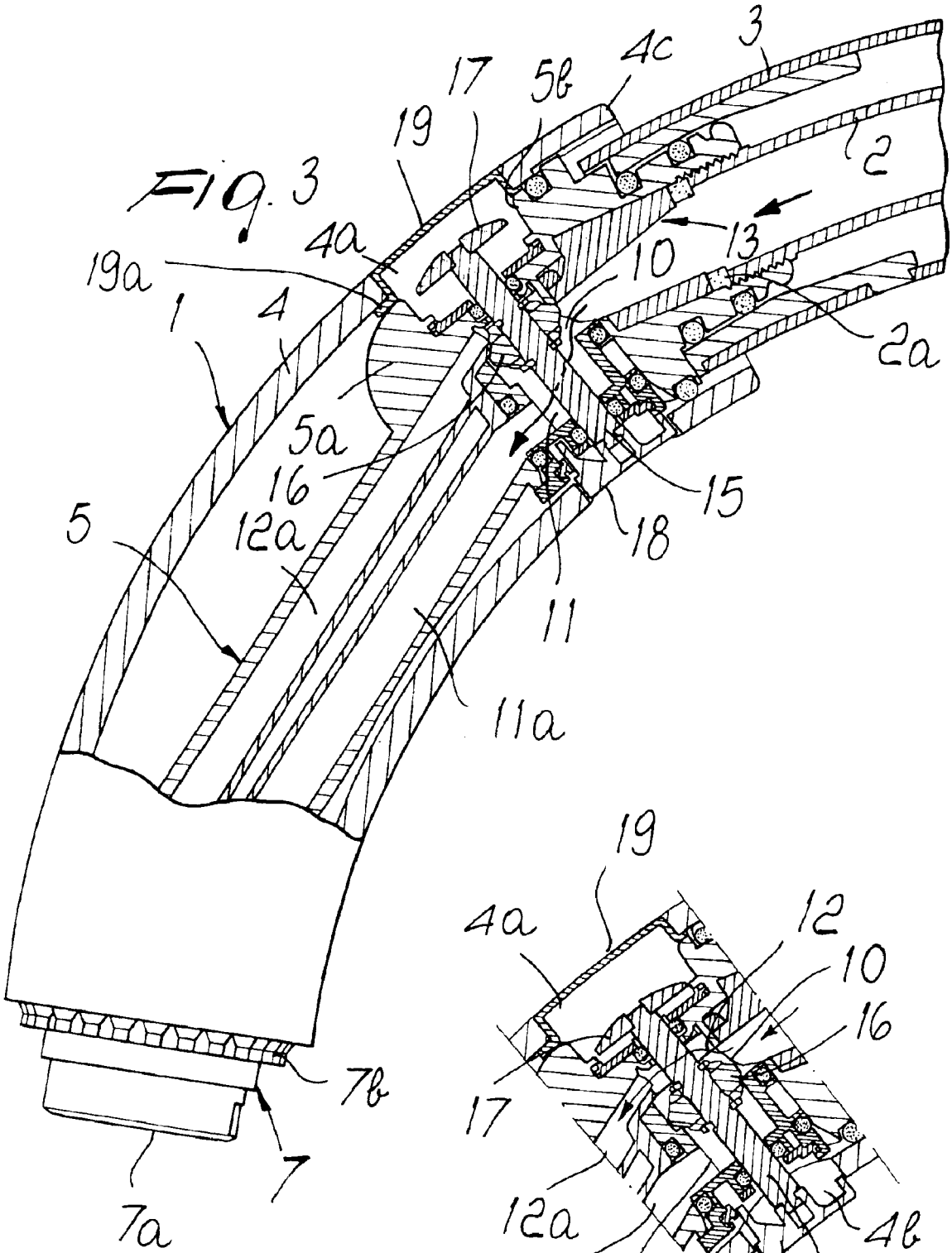
FIG. 3 is a partial sectional view of the sprayer.

With reference to the figures, the reference numeral 1 generally designates the sprayer or shower head, which is fixed to the end of a flexible water feed hose 2, which can be pulled out of a tubular body 3 of the faucet that is designed to contain said flexible hose.

The sprayer comprises, inside an enclosure 4, a central body 5, which is designed to convey water between an inlet 6, which is associated by way of a thread 6*a* with the end of the flexible hose 2, and an outlet disk 7, which comprises a central passage 7*a* and peripheral passages 7*b*.

The device that allows to switch the jet from central to peripheral and vice versa comprises a distribution unit 8, which is designed to be inserted in a seat 9 that is formed in the central body 5 and is provided with a water inlet 10, with a first water outlet 11, which is open onto a first duct 11*a* and is connected to the central passage 7*a*, and with a second outlet 12, which is open onto a second duct 12*a* connected to the peripheral passages 7*b*.

The locking of the distribution unit 8 in the cavity or seat 9 is performed by means of an insert 13, which is adapted to be inserted within the water inlet 6 until contact with the abutment 6*b* occurs, and to be locked thereat through action of the flexible hose 2 with the interposition of the gasket 2*a*: said insert 13 is provided with a fork-like protrusion or tab 13*a*, which is adapted to enter the distribution unit 8 so as to prevent any movement thereof through the water inlet 10.

A slider 14 is provided within the distribution unit 8, is adapted to work in a manner described hereafter and comprises a rod 15, which supports a flow control element 16 and has, at its ends, actuation buttons 17 and 18 that a user can access by means of openings 4*a* and 4*b* formed in the enclosure 4 respectively in front of the user who is about to operate the sprayer and in the opposite position.

The opening 4*a* is protected by a cap 19 made of elastic material, which is provided with a flap 19*a*, which is locked in contact with the internal surface of the enclosure 4 by the protrusions 5*a* and 5*b* that protrude from the central body, so as to ensure the stability of the positioning of said cap.

It should be noted, moreover, that the enclosure 4 is extended at the end 4*c* so as to surmount, in the position in which the sprayer 1 makes contact with the tubular body 3 shown in the figure, the outlet section of said body, so as to conceal any unpleasant situations of separation of said sprayer from said outlet section.

Operation of the invention is as follows:

by pressing the button 18 arranged on the back of the sprayer, the slider 13 has reached the position of FIG. 3; the flow control element 16 closes the second outlet 12 and leaves open the first outlet 11, so that the water that has arrived by means of the flexible hose 2 and has entered the distribution unit 8 through the inlet 10, by following the path indicated by the arrows, exits from the outlet 11 and flows toward the duct 11*a* in order to form the central jet.

Figure 4:
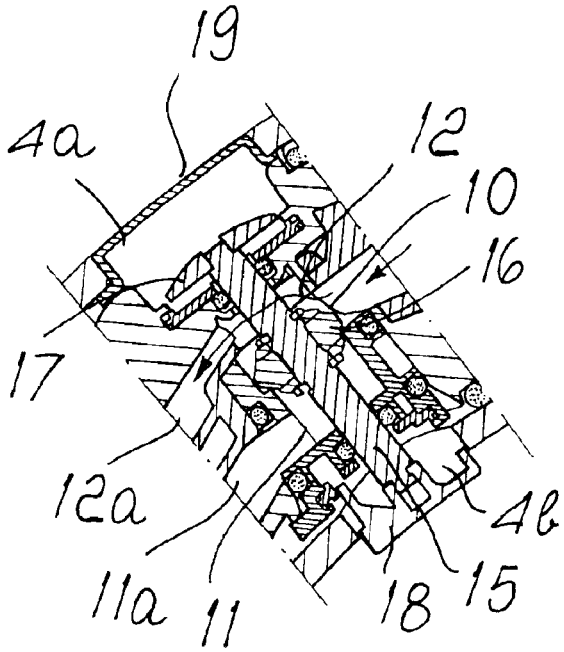
FIG. 4 is a view of a detail in a different step of operation.
Figure 5:
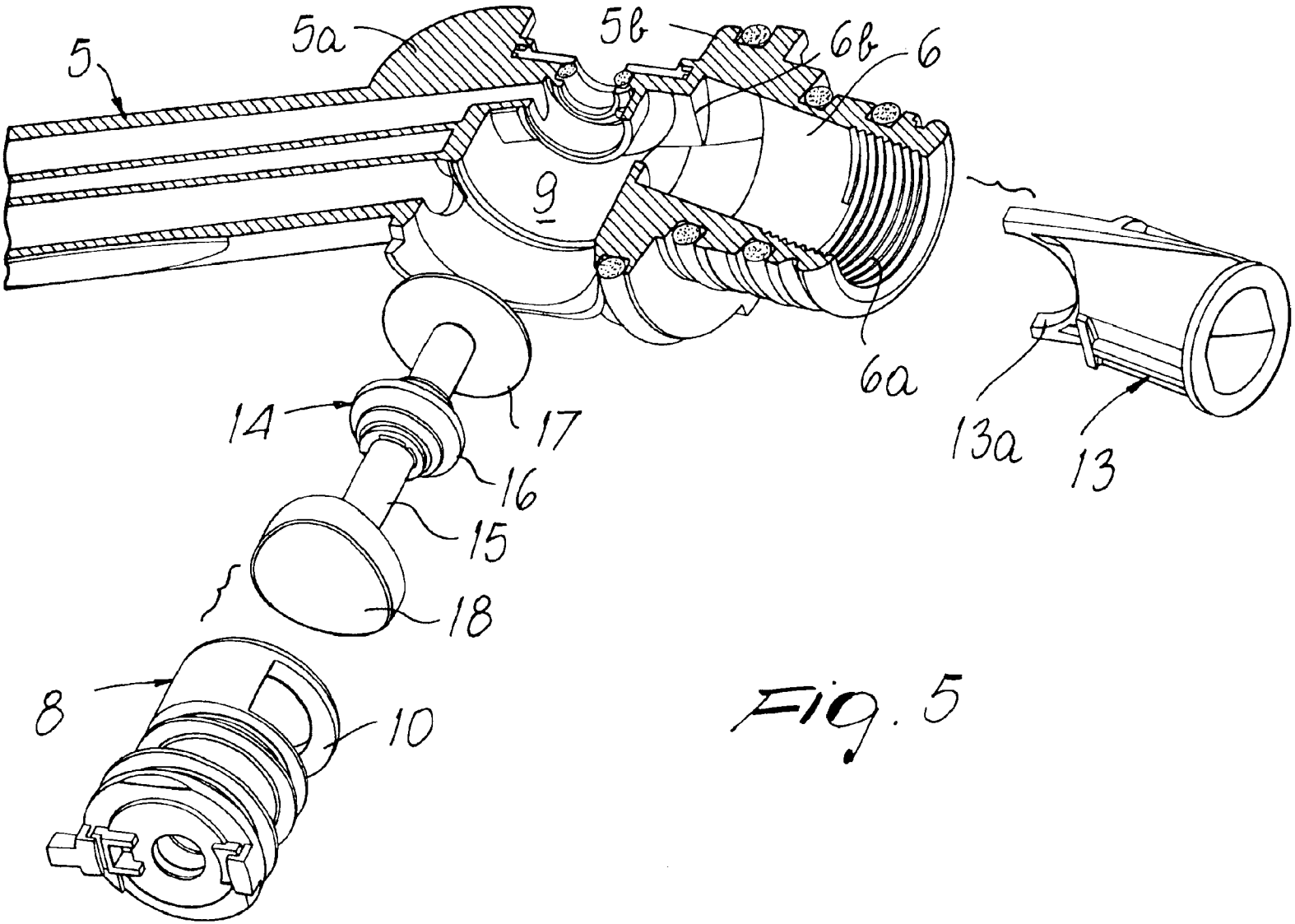
FIG. 5 is an exploded view of the sprayer according to the invention.

Switching from a central jet to a peripheral jet is performed by pressing the button 17 located on the front of the sprayer, i.e., in front of the user, assuming the position of FIG. 4 in which the flow control element 16 is in the position for closing the outlet 11 and opening the outlet 12: the water, by following the arrows shown in the figure, exits through said outlet 12 and flows toward the duct 12a in order to form the peripheral jet.

If one instead wishes the pressing of the button 17 located on the front of the sprayer to cause switching from peripheral jet to central jet, it is sufficient to provide a different shape of the ducts 11*a*, 12*a* in the central body 5, so that said duct 12*a* is connected to the central passage 7*a* instead of the peripheral passages 7*b* and said duct 11*a* reaches the peripheral passages 7*b*.

The described invention is susceptible of numerous modifications and variations, all of which are within the scope of the appended claims; all the details may further be replaced with other technically equivalent elements.

The disclosures in Italian Patent Application No. MN2002A000013 from which this application claims priority are incorporated herein by reference.

What is claimed is:

1. A pull-out kitchen sprayer, comprising: an outer enclosure having a shape such as to require assembly with a particular orientation with respect to a position of the user; a central body accommodated within said outer enclosure, said central body conveying water between an inlet associated with a flexible water feed hose and an outlet disk that comprises a central passage and peripheral passages; a first duct that is connected to said central passage; a second duct that is connected to said peripheral passages; a switching device for providing access of water selectively to said first duct and to said second duct, said switching device including a distribution unit that is inserted in a seat formed in said central body; locking means for locking said distribution unit in said seat; a water inlet; first and second water outlets, which open respectively onto said first duct connected to the central passage and onto said second duct connected to the peripheral passages; a slider that has a flow control element and a rod for supporting said flow control element, said rod being guided in said distribution unit so as to move between two positions in which said first and second outlets are selectively closed; actuation, buttons provided at respective opposite ends of said rod; and facing openings provided at said outer enclosure that allow a user to access said buttons, a first one of said openings being formed so as to face the user.

2. The sprayer of claim 1, wherein said locking means for locking the distribution unit within the seat formed in the central body comprises an insert for insertion in said central body, said insert being provided with a tab that enters said distribution unit so as to prevent any movement thereof.

3. The sprayer of claim 2, comprising an abutment located in the water inlet provided in the central body, said insert being inserted in the water inlet to contact said abutment and to be locked thereat by action of a flexible hose connected to said water inlet, said tab insert being shaped as a fork-like protrusion that is adapted to enter the distribution unit through the water inlet provided therein.

4. The sprayer of claim 1, further comprising raised portions that protrude from the central body, at least one of said openings provided in the outer enclosure to allow access to said actuation buttons provided at the ends of the rod included in the switching device comprising a covering cap made of elastic material, which is provided with a flap that makes contact with an internal surface of the enclosure in order to be locked by said raised portions.

5. The sprayer of claim 3, comprising a tubular body for accommodating the flexible hose, said outer enclosure extending so as to surmount, in a position in which the sprayer makes contact with the tubular body, the outlet section thereof.

6. The sprayer of claim 3, wherein said first outlet for water outflow from the distribution unit that leads into the first duct connected to the central passage is arranged on said distribution unit so as to be open, when said rod of the switching device is at a stroke limit reached by pressing one of said buttons that is accessed through a second one of said openings of the enclosure that is located opposite said first opening located in front of the user.

7. The sprayer of claim 3, wherein said first outlet for water outflow from the distribution unit that leads into said first duct connected to the central passage is arranged on said distribution unit so as to be open, when said rod of the switching device is at a stroke limit reached by pressing one of said buttons that is accessed through said first opening of the enclosure that is located in front of the user.

* * * * *